US009407026B2

(12) United States Patent
Campbell et al.

(10) Patent No.: US 9,407,026 B2
(45) Date of Patent: Aug. 2, 2016

(54) ELECTRICAL CONNECTOR WITH A TERMINAL POSITION ASSURANCE DEVICE

(71) Applicant: DELPHI TECHNOLOGIES, INC., Troy, MI (US)

(72) Inventors: Jeffrey Scott Campbell, West Bloomfield, MI (US); Wesley J. Weber, Jr., Metamora, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 14/694,310

(22) Filed: Apr. 23, 2015

(65) Prior Publication Data

US 2016/0013575 A1 Jan. 14, 2016

Related U.S. Application Data

(60) Provisional application No. 62/024,051, filed on Jul. 14, 2014.

(51) Int. Cl.
*H01R 13/514* (2006.01)
*H01R 13/436* (2006.01)

(52) U.S. Cl.
CPC ..... *H01R 13/4362* (2013.01)

(58) Field of Classification Search
CPC ..... H01R 13/4223; H01R 13/4362
USPC ..... 439/595, 752
See application file for complete search history.

(56) References Cited

U.S. PATENT DOCUMENTS 5,044,991 A * 9/1991 Colleran ..... H01R 13/5221 439/274
5,116,236 A * 5/1992 Colleran ..... H01R 13/4362 439/271
5,122,080 A 6/1992 Hatagishi
5,358,427 A * 10/1994 Miwa ..... H01R 13/4362 439/595
5,609,503 A * 3/1997 Tsuji ..... H01R 13/4362 439/733.1
5,653,613 A * 8/1997 Shimoda ..... H01R 13/4361 439/752
5,830,013 A * 11/1998 Saito ..... H01R 13/4362 439/595

(Continued)

FOREIGN PATENT DOCUMENTS

EP 1047153 A1 6/2004
WO 2007062683 A1 6/2007

*Primary Examiner* — Thanh Tam Le
(74) *Attorney, Agent, or Firm* — Robert J. Myers

(57) ABSTRACT

An electrical connector including an electrical terminal, a connector housing and a terminal position assurance (TPA) device. The connector housing defines a longitudinal cavity configured to receive the electrical terminal and a lateral cavity lateral cavity is in communication with the longitudinal cavity. The TPA device is received within the lateral cavity and is moveable from an initial position within the lateral cavity to a final position. The TPA device includes a flexible primary locking feature configured to cooperate with a corresponding locking feature of the electrical terminal to lock the electrical terminal in the longitudinal cavity when the TPA device is in the initial position. The TPA device further includes a rigid secondary locking feature configured to cooperate with the corresponding locking feature to lock the electrical terminal in the longitudinal cavity when the TPA device is in the final position.

10 Claims, 8 Drawing Sheets

(56) References Cited

U.S. PATENT DOCUMENTS

| | | | | |
|---|---|---|---|---|
| 5,839,923 | A * | 11/1998 | Yoshida | H01R 13/4362 439/752 |
| 6,010,374 | A * | 1/2000 | Miwa | H01R 13/4362 439/752 |
| 6,132,252 | A | 10/2000 | Chaillot | |
| 6,648,699 | B1 * | 11/2003 | Makino | H01R 13/4362 439/595 |
| 7,396,255 | B2 | 7/2008 | Morello et al. | |
| 7,556,539 | B2 * | 7/2009 | Takahashi | H01R 13/4362 439/752 |
| 7,717,758 | B2 * | 5/2010 | Fukamachi | H01R 13/4362 439/595 |
| 8,210,864 | B1 | 7/2012 | Hernandez et al. | |
| 2011/0256752 | A1 | 10/2011 | Sakamoto et al. | |

* cited by examiner

ELECTRICAL CONNECTOR WITH A TERMINAL POSITION ASSURANCE DEVICE

CROSS-REFERENCE TO RELATED APPLICATION

This application claims the benefit under 35 U.S.C. §119 (c) of U.S. Provisional Patent Application No. 62/024,051 filed Jul. 14, 2014, the entire disclosure of which is hereby incorporated herein by reference.

TECHNICAL FIELD OF THE INVENTION

The invention relates to electrical connectors, and more particularly relates to an electrical connector including a terminal position assurance device having two sets of terminal locking features.

BACKGROUND OF THE INVENTION

Electrical terminals locked into a connector housing are subject to retention strength performance issues, especially with the smaller size categories of terminals (e.g. less than 2.8 mm). These smaller terminals historically have used scaled down locking features, which inherently have reduced locking retention strength and allow excessive terminal float. An excessively floating terminal can stub during mating, resulting in the terminal pushing out, and/or terminal damage especially if the retention strength within the connector housing is low. Within the automotive industry, inadequately locked terminals which pull out or push out, are recognized as the second highest root cause for failure of electrical connector systems within the vehicle warranty period.

Electrical connectors typically comprise internal cavities that are intended to accommodate electrical (male and/or female) terminals inserted from a rear face of the electrical connector. To ensure a well and safe functioning of the connector, it has to be ensured that the electrical terminals are locked in place within the electrical connector.

A solution known in the art includes providing a primary locking feature in form of a resilient retaining shoulder for preventing rearward withdrawal of the electrical terminals. The retaining shoulder, which is formed in the electrical connector, is designed to make a snap fit into a corresponding recess of the electrical connector at the end of the insertion of the electrical connector. A flexible retaining member is thereby disposed contiguously between the internal cavity and a slot, into which the retaining member can deflect. The retaining shoulder is formed on the face of the flexible retaining member that communicates with the internal cavity, such that on inserting the electrical terminal into the internal cavity, the retaining member first deflects in the slot before the retaining shoulder engages the recess of the electrical terminal.

In order to secure the primary locking, it is known e.g. from U.S. Pat. No. 6,132,252 to insert an additional locking member built as a rail into the slot next to the retaining member as a secondary locking. The electrical terminal being fully inserted into the internal cavity and the primary locking being engaged, the locking member is inserted into the slot from a front face of the electrical connector according to a direction corresponding to the loading direction of the electrical terminal. The retaining member is thus prevented from being flexed away from the internal cavity, thereby firmly retaining the electrical terminal. If the electrical terminal is incompletely inserted into the internal cavity, the retaining member is maintained in a deflected position into the slot, such that the locking member cannot be mounted.

The secondary locking mechanism known in the art requires a locking member being inserted frontward of the electrical connector in the direction opposite to that of the insertion of the electrical terminal. However, the configuration of the electrical connector may be such that a frontward insertion of the locking member is not possible, e.g. because there is not enough space at the front face side. In addition, the retaining members in connectors used with smaller terminals may easily buckle, terminal tangs may bend, and secondary locking mechanism may provide limited additional strength due to packaging constraints with terminals smaller than 2.8 mm. These solutions to date have only met the minimum terminal retention requirements, in many cases, all with little to no performance margin.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention, an electrcial connector is provided. The electrical connector includes an electrical terminal and a connector housing defining a first internal cavity that extends along a longitudinal axis from a first face to a second face of the connector housing. The connector housing defines a first opening in the first face that is configured to receive the electrical terminal. The connector housing further defines a second internal cavity that extends along a lateral axis that is transverse to the longitudinal axis. The second cavity is in communication with the first cavity. The electrical connector further includes a terminal position assurance (TPA) device that is configured to be received within the second cavity. The TPA device includes a flexible primary locking feature that is configured to cooperate with a corresponding locking feature of the electrical terminal and to lock the electrical terminal in the first cavity when the TPA device is in a first position within the second cavity. The TPA device further includes a rigid secondary locking feature that is configured to cooperate with the corresponding locking feature of the electrical terminal and to lock the electrical terminal in the first cavity when the TPA device is in a second position within the second cavity. The second position is distinct from the first position.

The primary locking feature may be disengaged from the corresponding locking feature of the electrical terminal when the TPA device is moved to the second position. The TPA device may be configured to move from the first position to the second position along the lateral axis and transversely relative to the longitudinal axis. The TPA device may be configured to be inserted in the second cavity transversally to the first cavity through a lateral opening.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
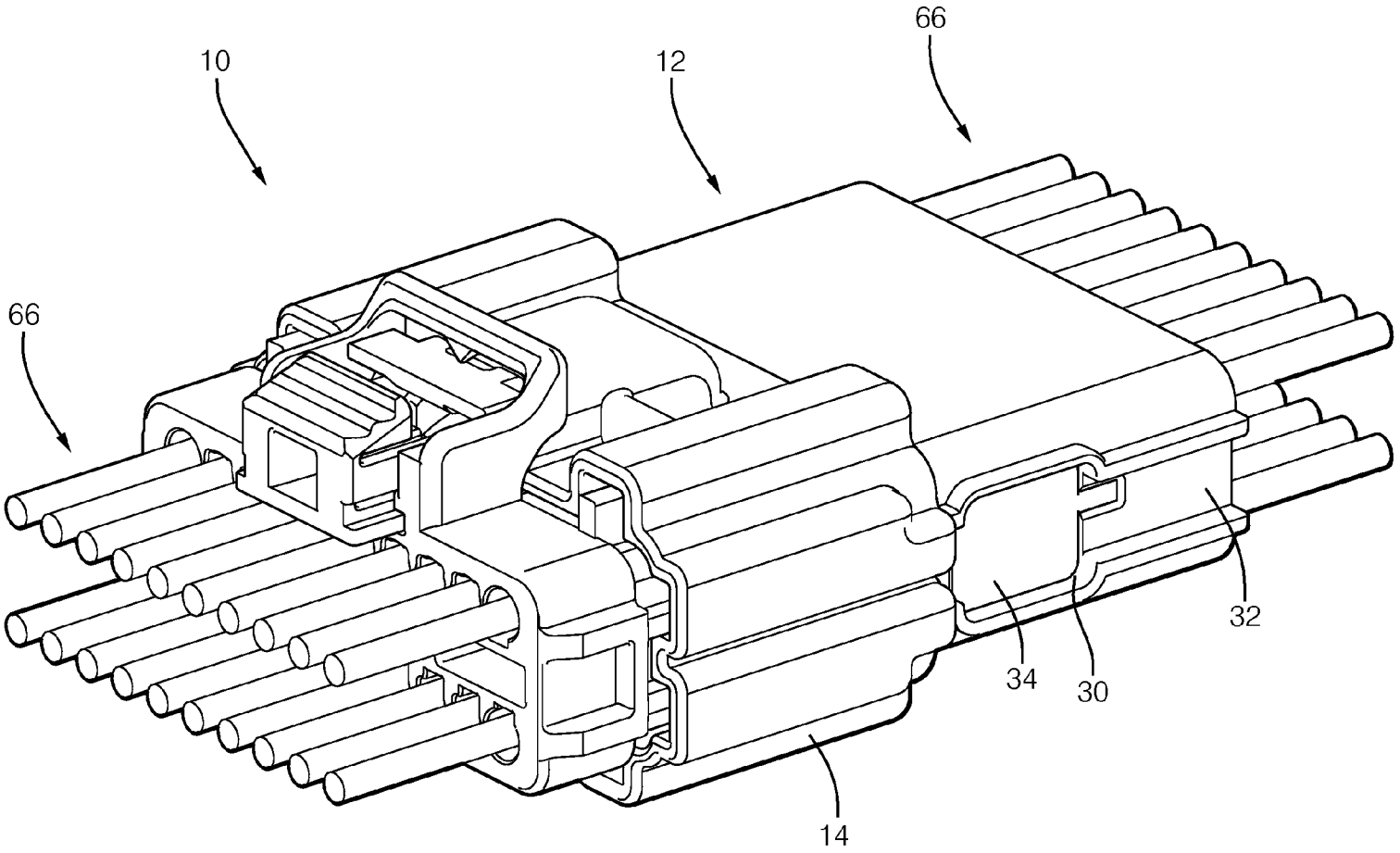
FIG. 1 is a perspective exploded view of a electrical connector including a movable terminal position assurance (TPA) device and a corresponding mating electrical connector in accordance with one embodiment.
Figure 2A:
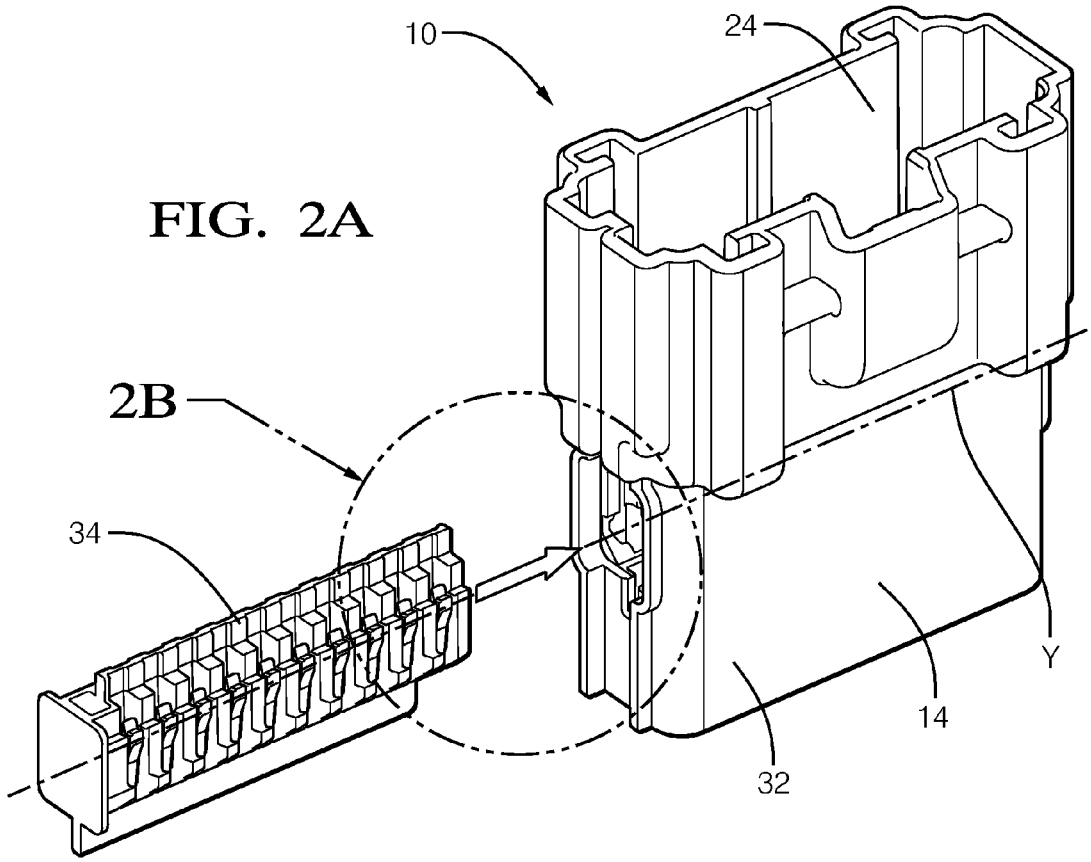
FIG. 2A is a exploded perspective view of the electrical connector of FIG. 1 including the TPA device in accordance with one embodiment.
Figure 2B:
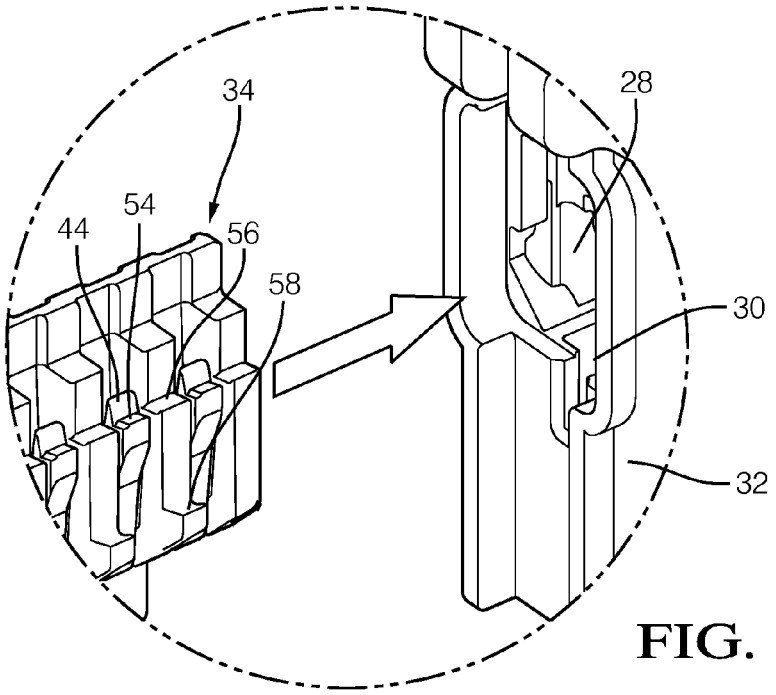
FIG. 2B is a close-up view of a lateral cavity the electrical connector accommodating the TPA device of FIG. 1 in accordance with one embodiment.
Figure 3:
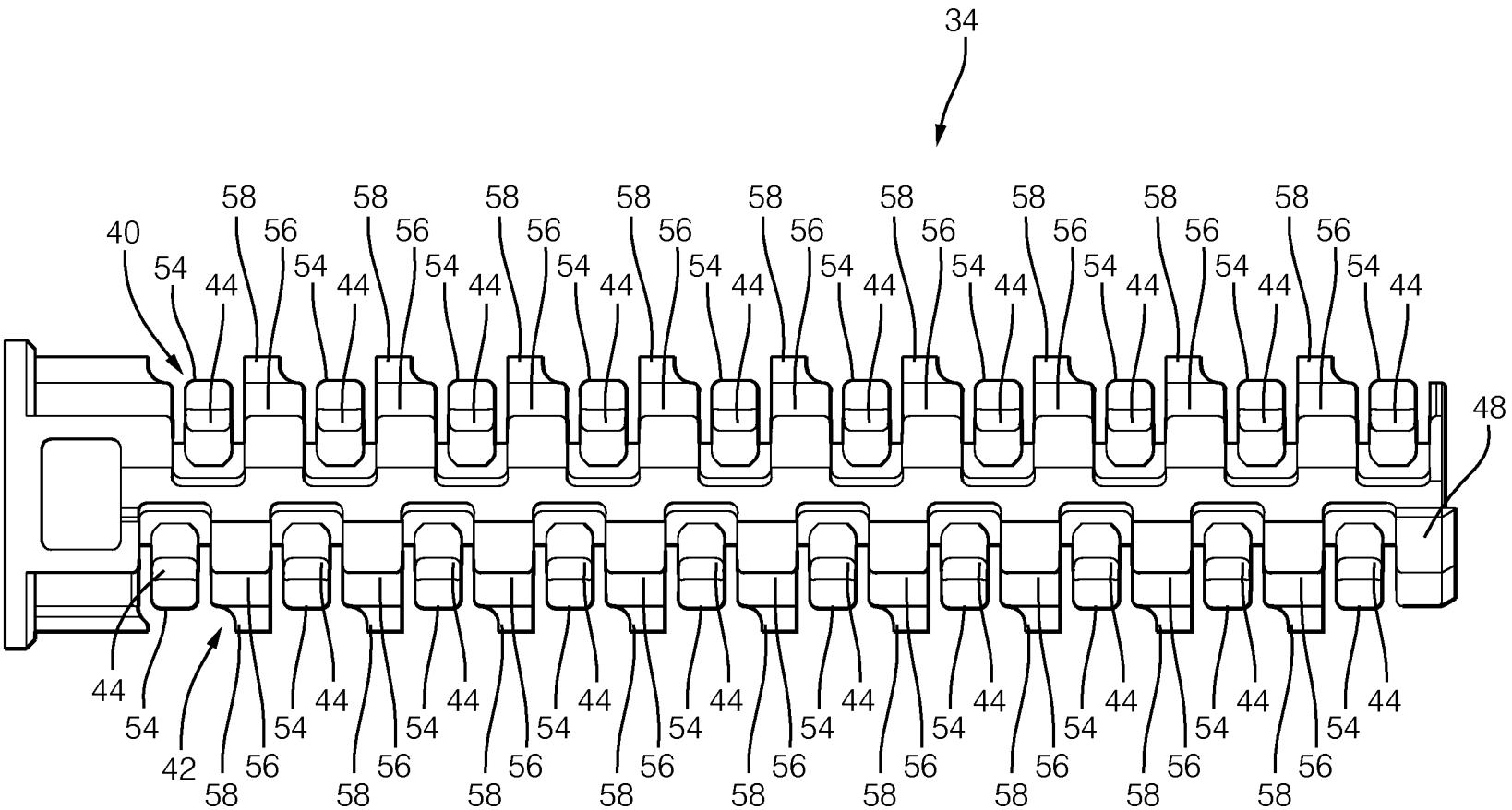
FIG. 3 is a front view of the TPA device of FIG. 1 in accordance with one embodiment.

Presented herein is an electrical connector including a moveable terminal position assurance (TPA) device. The TPA device secures the contacts or terminals of the connector within cavities in the connector housing once the terminals are fully inserted within the housing. The TPA device incorporates a flexible primary lock finger to engage a lock ridge of a terminal when the terminal is inserted into a cavity of a connector housing while the TPA is in an initial terminal insertion position. After insertion of all the terminals into the connector housing, the TPA is moved to a final terminal locking position. This action disengages the primary lock finger, and engages a rigid secondary lock on the TPA device.

Cross-referencing FIGS. 1-7, details of a non-limiting example of an electrical connector 10 can be seen. The electrical connector 10 is configured to mate with a corresponding mating connector 12. A connector housing 14 of the electrical connector 10 has a first internal cavity 16, hereinafter referred to as a terminal cavity 16, that extends along a longitudinal axis X of the connector housing 14 from an opening 18 in a first face 20, hereinafter referred to as an insertion end 20, of the connector housing 14 to an opening 22 into an integral socket 24 in a second face 26, hereinafter referred to as a mating end 26, of the connector housing 14. The connector housing 14 also has second internal cavity 28, hereinafter referred to as a TPA cavity 28, that extends along a lateral axis Y of the connector housing 14 that is transverse, or generally perpendicular, to the longitudinal axis X. As used herein, generally perpendicular is ±10° of absolutely perpendicular. This second internal cavity 28 defines a first opening 30 in a lateral wall 32 of the connector housing 14 that is configured to receive a terminal position assurance (TPA) device 34 that is configured to secure an electrical terminal 36 within the terminal cavity 16 once the terminal 36 is fully inserted within the terminal cavity 16. The TPA device 34 is formed of a dielectric material, such as polyamide, polypropylene, or polybutylene terephthalate. At least one wall 38 of the terminal cavity 16 is open to and in communication with the TPA cavity 28. The TPA device 34 is movable within the TPA cavity 28 from an initial position 39 before the terminal 36 is inserted into the terminal cavity 16 to a final position 41 after the terminal 36 is fully inserted within the terminal cavity 16.

The TPA device 34 includes a flexible primary locking feature 40 and rigid secondary locking feature 42 each configured to secure the terminal 36 within the terminal cavity 16. The secondary locking feature 42 is laterally adjacent the primary locking feature 40. The TPA device 34 and the TPA cavity 28 are configured to that the TPA device 34 slides laterally within the TPA cavity 28. The primary locking feature 40 is a flexible beam 44 that is attached at one end 46 to a cross bar 48 of the TPA device 34. The flexible beam 44 extends along the longitudinal axis X. An unattached end 50 of the flexible beam 44 defines a ramp 52 that slopes toward the insertion end 20 of the terminal cavity 16. The ramp 52 leads to a first lock shoulder 54 that is preferably, but not necessarily, set at a slight back angle.

Figure 4A:
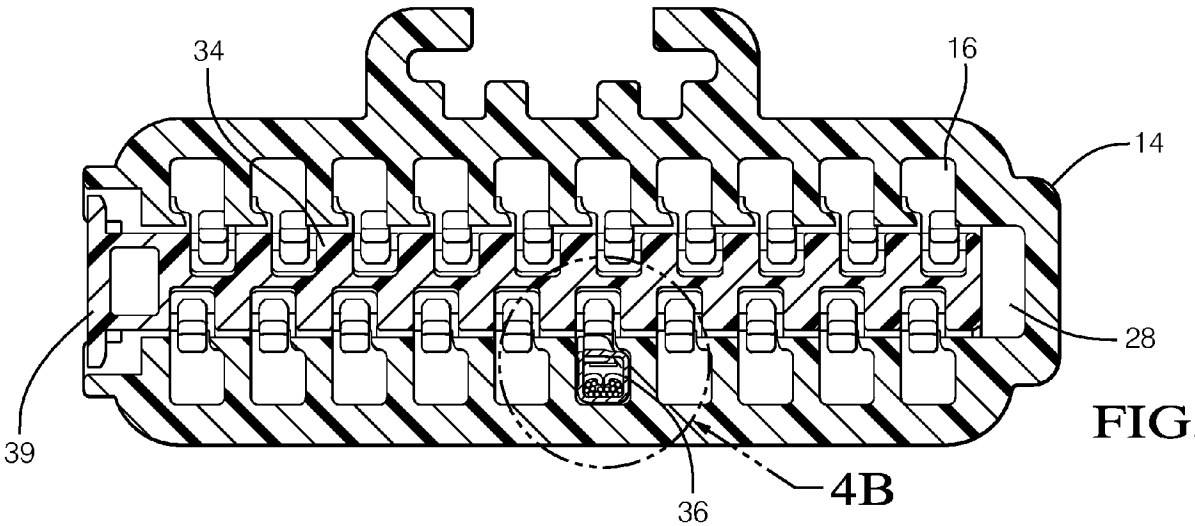
FIG. 4A is a cross sectional front view of the electrical connector of FIG. 1 with the TPA device in a terminal insertion position in accordance with one embodiment.
Figure 4B:
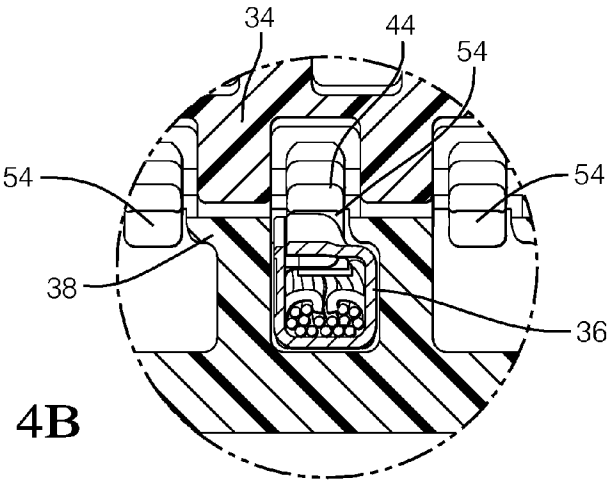
FIG. 4B is a close-up cross sectional front view of the movable TPA device of FIG. 1 engaging an electrical terminal while the TPA device is in the terminal insertion position of FIG. 4A in accordance with one embodiment.
Figure 7:
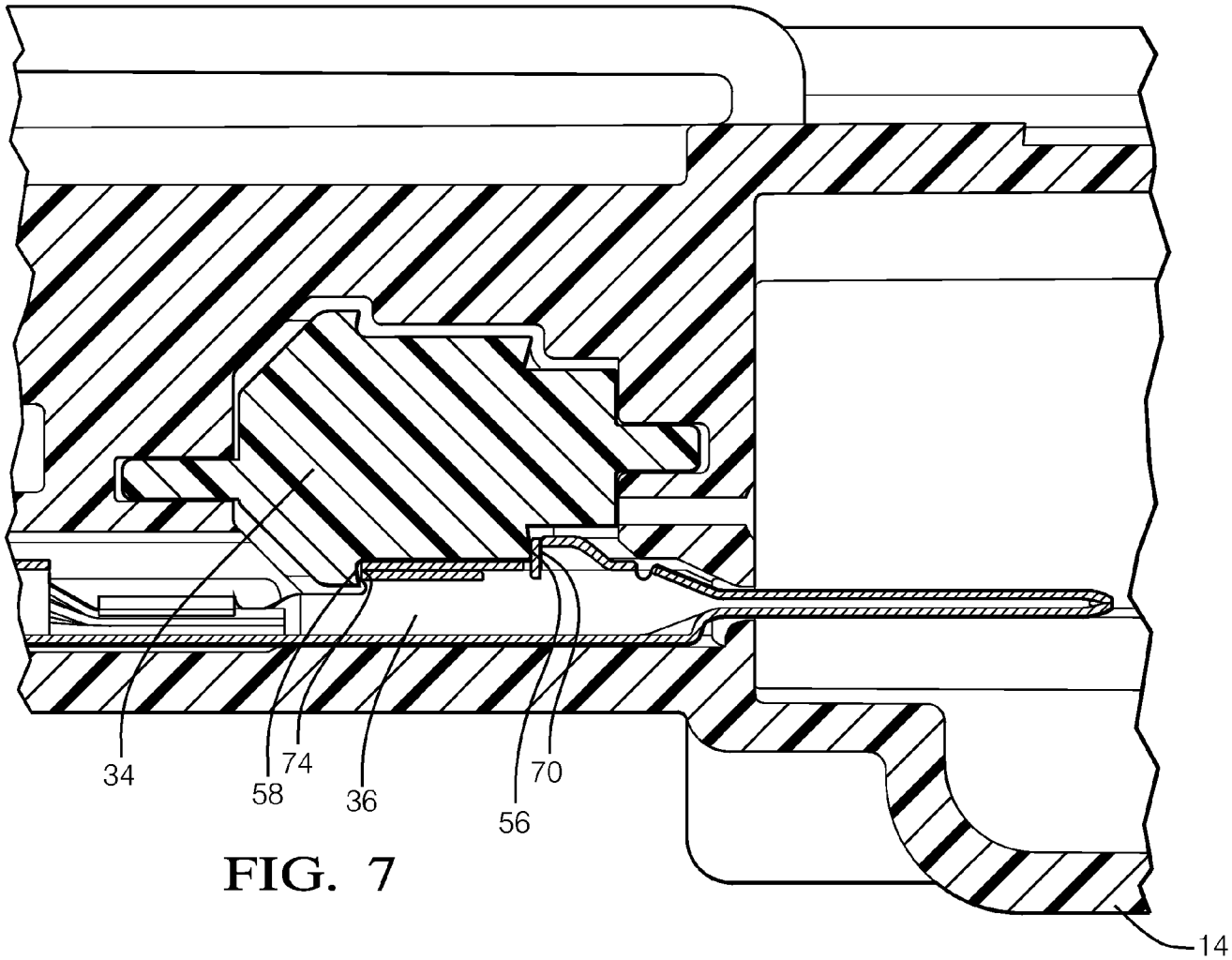
FIG. 7 is a close-up cross sectional side view of the TPA device of FIG. 1 engaging the electrical terminal while the TPA device is in the terminal locking position of FIG. 6A in accordance with one embodiment.

As best shown in FIG. 4B, the primary locking feature 40 is aligned within the terminal cavity 16 when the TPA device 34 is in the initial position 39 before the terminal 36 is inserted into the cavity 28 from the insertion end 20. The secondary locking feature 42 of the TPA device 34 has a rigid second lock shoulder 56 defined by the cross bar 48 of the TPA device 34. As best illustrated in FIG. 7, the secondary locking feature 42 may also include a rigid third lock shoulder 58 defined by the cross bar 48 of the TPA device 34.

Figure 6A:
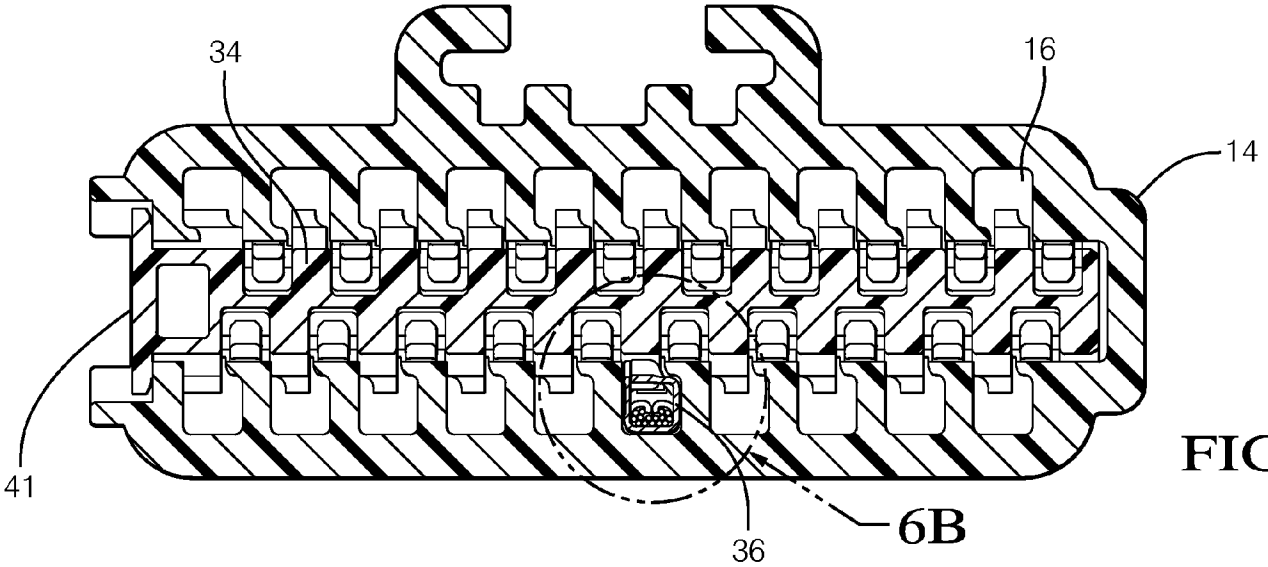
FIG. 6A is a cross sectional front view of the electrical connector of FIG. 1 with the TPA device in a terminal locking position in accordance with one embodiment.
Figure 6B:
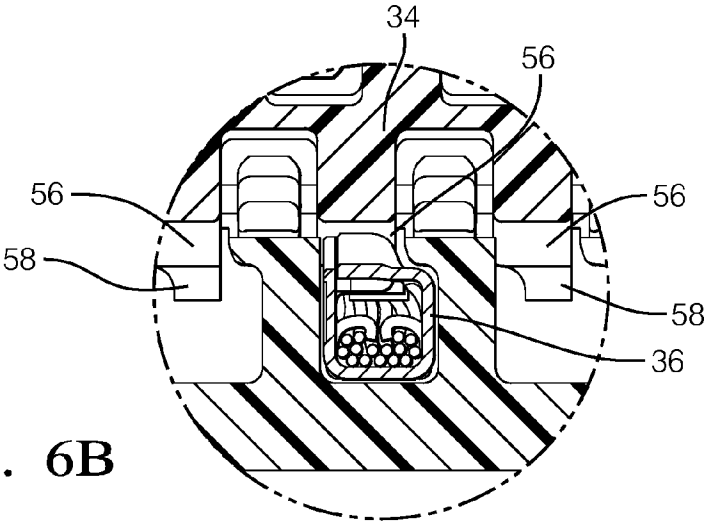
FIG. 6B is a close-up cross sectional front view of the TPA device of FIG. 1 engaging the electrical terminal while the TPA device is in the terminal locking position of FIG. 6A in accordance with one embodiment.

As best shown in FIG. 6B, the secondary locking feature 42 is aligned within the terminal cavity 16 and the primary locking feature 40 is moved out of the terminal cavity 16 when the TPA device 34 is in the initial position 39 before the terminal 36 is inserted into the cavity 28 from the insertion end 20.

Focusing now on a typical electrical terminal 36, it generally includes a forward contact portion 60, an intermediate body portion 62, and a rearward attachment portion 64 for attaching the terminal 36 to the insulated conductor wire 66. The body portion 62 has an inclined portion 68 that slants rearward and leads to a corresponding locking feature 70, characterized as a first lock surface 70. The body portion 62 also includes a flat surface 72 intermediate the inclined portion 68 and the first lock surface 70. The body portion 62 may also include a second lock surface 74 at the end of the body portion 62 adjacent the rearward attachment portion 64.

Figure 5:
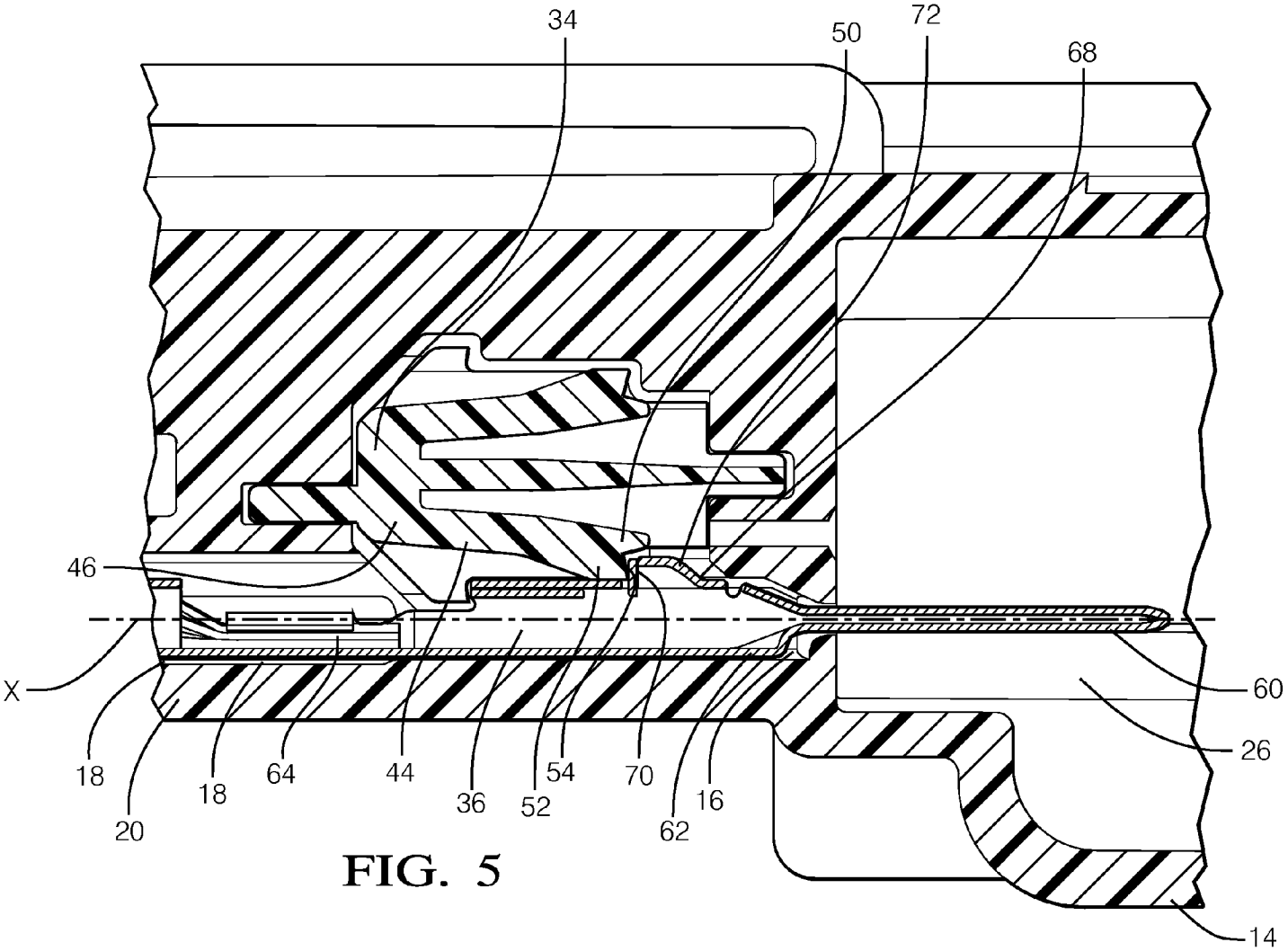
FIG. 5 is a close-up cross sectional side view of the TPA device of FIG. 1 engaging the electrical terminal while the TPA device is in the terminal insertion position of FIG. 4A in accordance with one embodiment.

The terminal 36 is inserted into the terminal cavity 16 through the opening 18 at the insertion end 20 of the connector housing 14 when the TPA device 34 is in the initial position 39. As best shown in FIG. 5, when the inclined portion 68 of the body portion 62 engages the ramp 52 of the flexible beam 44, the inclined portion 68 deflects the flexible beam 44 so that the ramp 52 of the flexible beam 44 rides over the inclined portion 68 and flat surface 72 as the terminal 36 is further inserted within the cavity 28. When the first lock shoulder 54 reaches the first lock surface 70, the flexible beam 44 springs back to a generally undeflected position and the first lock shoulder of the flexible beam 44 engages the first lock surface 70 of the terminal 36, inhibiting the terminal 36 from being pulled back out of the insertion end 20 of the connector housing 14.

After the terminal 36 is fully inserted into the terminal cavity 16 and engaged with the primary locking feature 40, the TPA device 34 is laterally moved within the TPA cavity 28 from the initial position 39 to the final position 41. The primary locking feature 40 is moved from the terminal cavity 16 and the secondary locking feature 42 is moved into the terminal cavity 16 so that the second lock shoulder 56 now engages the first lock surface 70 and the third lock shoulder 58 engages the second lock surface 74 of the terminal 36.

As illustrated in FIGS. 1-7, the connector housing 14 includes multiple terminal cavities 16, so the TPA device 34 is positioned in the initial position 39 where the primary locking feature 40 holds each terminal 36 within its terminal cavity 16 until all of the terminals 36 are inserted into the terminal cavities 16. Once all of the terminal cavities 16 are filled, the TPA device 34 is moved into the final position 41 so that the terminals 36 are held within the terminal cavities 16 by the secondary locking feature 42.

Terminals 36 are preferably, but not necessarily, symmetrical about a horizontal plane so that the terminals 36 are insertable into the respective terminal cavities 16, as best shown in FIG. 4A, either right side up or upside down.

Each terminal 36 can be removed from its terminal cavity 16 by inserting a tool into an access slot and depressing the primary locking feature 40 until the first lock surface 70 is released by the first lock shoulder 54 when the TPA device 34 is in the initial position 39.

Figure 8:
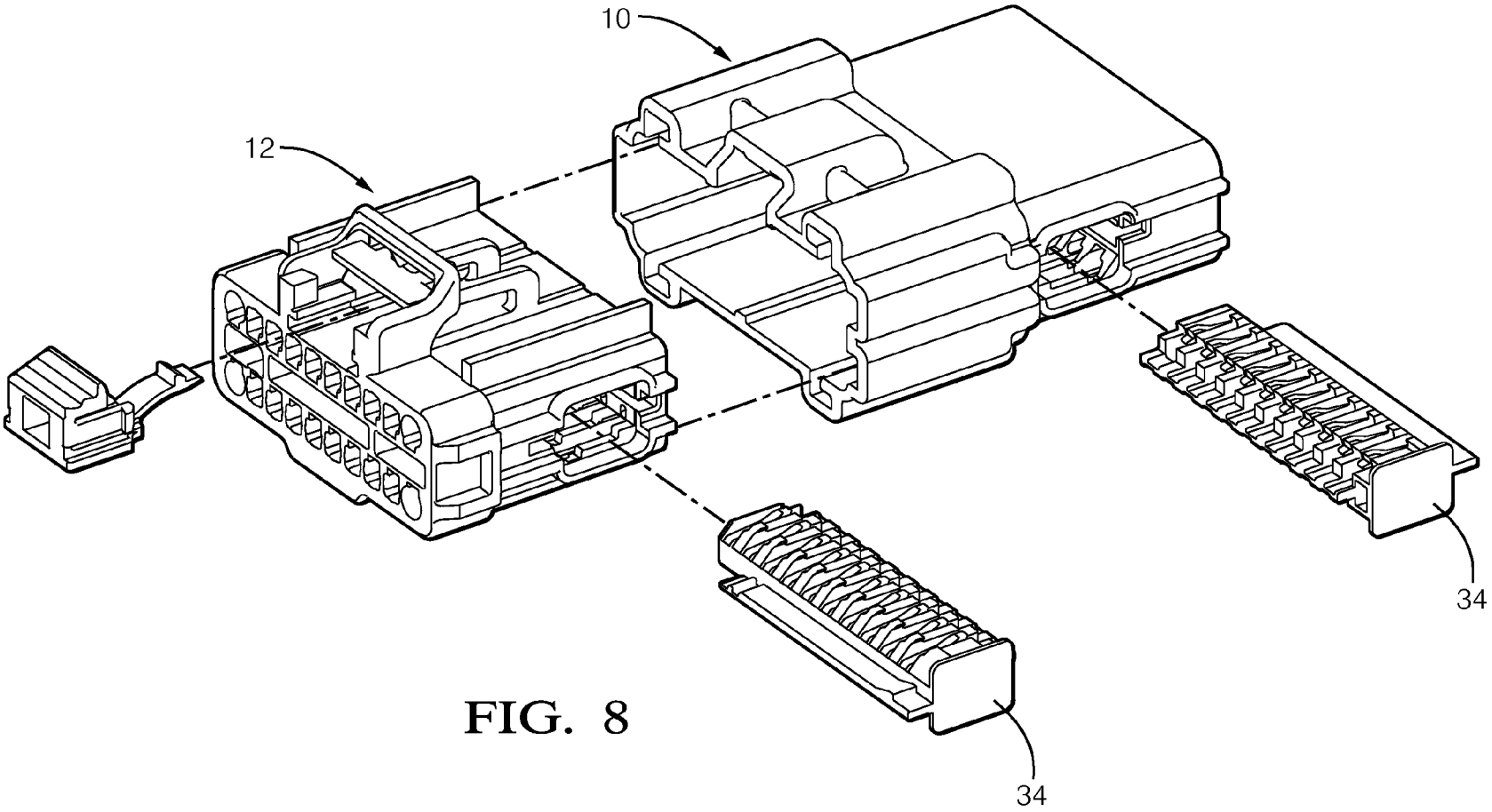
FIG. 8 is a perspective exploded view of a male electrical connector and a female electrical connector each including a TPA device in accordance with one embodiment.

While the electrical connector 10 shown in FIGS. 1-7 is designed to contain male terminals 36, as shown in FIG. 8 the TPA device 34 can also be adapted for use in the corresponding mating connector 12 designed to contain female terminals.

Accordingly an electrical connector 10 including a TPA device 34 is provided. The TPA device 34 has the benefit of engaging multiple locking surfaces (56, 58) of the terminal 36 when the secondary locking feature 42 is engaged, fully locking the terminal 36 within the terminal cavity 16. The TPA device 34 also provides a reduction of positional float of the terminal 36 within the terminal cavity 16 which greatly improves the alignment of terminals 36 within the connector housing 14 and reduces the chance of terminal push-out and/or terminal damage during connection with the corresponding mating connector 12. Because the primary locking feature 40 is only required to hold the terminals 36 within the terminal cavities 16 during the terminal insertion process. The primary locking feature 40 may be designed to optimize the terminal insertion force without regard to final retention force since that is separately provided by the secondary locking feature 42. This electrical 10 connector has been found to provide superior terminal retention for electrical terminals less than 2.8 mm.

Although the TPA device 34 in the illustrated example is configured to slide laterally within the TPA cavity 28, other embodiments may include a TPA device that moves rotationally or helically within the TPA cavity to engage the primary or secondary locking feature with the terminal lock surfaces.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An electrical connector, comprising:

an electrical terminal;

a connector housing defining a first internal cavity extending along a longitudinal axis from a first face to a second face of the connector housing and defining a first opening in said first face configured for insertion of the electrical terminal, said first internal cavity configured to receive the electrical terminal, said connector housing further defining a second internal cavity extending along a lateral axis transverse to said longitudinal axis, wherein said second internal cavity is in communication with said first internal cavity; and a terminal position assurance (TPA) device configured to be received within the second internal cavity and moveable from an initial position within the second internal cavity to a final position that is distinct from the initial position, wherein said TPA device includes a flexible primary locking feature having a flexible beam that is attached at one end to a cross bar of the TPA device, a free end of the flexible beam defines a ramp that slopes toward the first opening, and a first lock shoulder that is configured to cooperate with a first locking feature of the electrical terminal to retain said electrical terminal in said first internal cavity when the TPA device is in the initial position within the second internal cavity, wherein said TPA device further includes a rigid secondary locking feature having a rigid second lock shoulder defined by the cross bar of the TPA device and configured to cooperate with the first locking feature and a rigid third lock shoulder defined by the cross bar of the TPA device and configured to cooperate with a second locking feature of the electrical terminal to lock said electrical terminal in said first internal cavity when the TPA device is in the final position, and wherein the second lock shoulder is longitudinally offset from the third lock shoulder.

2. The electrical connector according to claim 1, wherein the primary locking feature is disengaged from the first locking feature of the electrical terminal when the TPA device is moved to the final position.

3. The electrical connector according to claim 1, wherein the TPA device is configured to move from the initial position to the final position along the lateral axis and move transversely relative to the longitudinal axis.

4. The electrical connector according to claim 1, wherein the TPA device is configured to be inserted in said second internal cavity transversally to the first internal cavity through a lateral opening defined by the connector housing.

5. The electrical connector according to claim 1, wherein the electrical terminal comprises a forward contact portion, an intermediate body portion, and a rearward attachment portion configured to attach the electrical terminal to an insulated conductor wire, wherein the body portion has an inclined portion that slants rearward toward the first locking feature.

6. The electrical connector according to claim 5, wherein the body portion of the electrical terminal comprises a flat surface intermediate the inclined portion and the first locking feature and wherein the body portion further comprises the second locking feature which is distinct from the first locking feature and located at an end of the body portion rearward from the first locking feature.

7. The electrical connector according to claim 6, wherein the first lock shoulder of the flexible beam engages the first locking feature of the electrical terminal when the TPA device is in the initial position.

8. The electrical connector according to claim 7, wherein the second lock shoulder engages the first locking feature and the third lock shoulder engages the second locking feature of the electrical terminal when the TPA device is in the final position.

9. The electrical connector according to claim 1, wherein the electrical terminal is a male terminal.

10. The electrical connector according to claim 1, wherein the electrical terminal is a female terminal.

* * * * *